US011091292B2

(12) United States Patent
Schuver

(10) Patent No.: US 11,091,292 B2
(45) Date of Patent: Aug. 17, 2021

(54) RESEALABLE BEVERAGE CAN LID

(71) Applicant: Steven S. Schuver, St. Louis, MO (US)

(72) Inventor: Steven S. Schuver, St. Louis, MO (US)

(73) Assignee: SBH, INC., St. Louis, MO (US)

( * ) Notice: Subject to any disclaimer, the term of this patent is extended or adjusted under 35 U.S.C. 154(b) by 26 days.

(21) Appl. No.: 16/835,128

(22) Filed: Mar. 30, 2020

(65) Prior Publication Data

US 2020/0223583 A1 Jul. 16, 2020

Related U.S. Application Data

(63) Continuation-in-part of application No. 16/383,415, filed on Apr. 12, 2019, now Pat. No. 10,773,854, and a continuation-in-part of application No. 16/193,711, filed on Nov. 16, 2018, now Pat. No. 10,611,515, and a continuation-in-part of application No. 16/186,233, filed on Nov. 9, 2018, now Pat. No. 10,597,192, and a continuation-in-part of application No. 16/109,575, filed on Aug. 22, 2018, now Pat. No. 10,676,237, and a continuation-in-part of application No. 15/990,333, filed on May 25, 2018, now Pat. No. 10,518,929, and a continuation-in-part of application No. 15/976,634, filed on May 10, 2018, now Pat. No. 10,562,665, said application No. 16/383,415 is a continuation-in-part of application No. 15/923,789, filed on Mar. 16, 2018, now Pat. No. 10,562,664.

(51) Int. Cl.
*B65D 17/28* (2006.01)

(52) U.S. Cl.
CPC .. *B65D 17/4014* (2018.01); *B65D 2517/0014* (2013.01)

(58) Field of Classification Search
CPC ..... B65D 17/4014; B65D 17/4011; B65D 17/4012; B65D 17/404; B65D 17/401; B65D 17/28; B65D 51/20; B65D 51/28; B65D 51/221; B65D 51/18; B21D 51/383; B21D 51/38
USPC ..... 220/258.5, 258.4, 258.3, 258.1, 256.1, 220/259.1, 259.3, 259.4, 730, 254.9, 220/254.3, 254.1, 270, 272, 273, 276, 220/269, 268, 266, 265; 413/14, 12, 8
See application file for complete search history.

(56) References Cited

U.S. PATENT DOCUMENTS 3,805,989 A 4/1974 Walker
3,967,752 A 7/1976 Cudzik
(Continued)

FOREIGN PATENT DOCUMENTS

WO WO-2011117772 A1 * 9/2011 ..... B65D 17/4014

*Primary Examiner* — Robert J Hicks
(74) *Attorney, Agent, or Firm* — David H. Chervitz

(57) ABSTRACT

A resealable beverage can lid has a lid having a top side having a partial score line forming a panel and a hinge with the panel capable of being partially freed from the lid along the partial score line with the hinge preventing the panel from being completely freed from the lid with the panel being moved from a closed position to an opened position once the panel is partially freed from the lid, a rivet formed in the lid and extending outwardly from the top side of the lid, a tab portion connected to the rivet, the tab portion having a front capturing portion and a rear lifting portion, and a latch element formed in the panel with the latch element capable of being captured by the front capturing portion for movement of the panel back into the closed position.

19 Claims, 7 Drawing Sheets

(56) References Cited

U.S. PATENT DOCUMENTS

| | | | | | |
|---|---|---|---|---|---|
| 4,039,100 | A * | 8/1977 | Wells | B65D 17/4012 220/269 |
| 4,234,099 | A * | 11/1980 | Tarro | B65D 17/166 206/807 |
| 4,433,792 | A | 2/1984 | Mandel | |
| 4,887,712 | A | 12/1989 | Wells | |
| 5,351,853 | A | 10/1994 | Shock | |
| 5,452,818 | A | 9/1995 | Yost | |
| 9,315,305 | B2 | 4/2016 | Robinson | |
| 2004/0256388 | A1 | 12/2004 | Rossetti et al. | |
| 2013/0087563 | A1 | 4/2013 | Brandtner | |
| 2020/0002051 | A1 * | 1/2020 | Fernandes | B65D 17/4012 |

* cited by examiner

RESEALABLE BEVERAGE CAN LID

CROSS REFERENCE TO RELATED APPLICATIONS

This application is a continuation-in-part of U.S. patent application Ser. No. 16/383,415 filed on Apr. 12, 2019, and is a continuation-in-part of U.S. patent application Ser. No. 16/193,711 filed on Nov. 16, 2018, and is a continuation-in-part of U.S. patent application Ser. No. 16/109,575 filed on Aug. 22, 2018, and is a continuation-in-part of U.S. patent application Ser. No. 15/923,789 filed on Mar. 16, 2018, which is now U.S. Pat. No. 10,562,664, and is continuation-in-part of U.S. patent application Ser. No. 15/976,634 filed on May 10, 2018, which is now U.S. Pat. No. 10,562,665, and is a continuation-in-part of U.S. patent application Ser. No. 15/990,333 filed on May 25, 2018, which is now U.S. Pat. No. 10,518,929, and is a continuation-in-part of U.S. patent application Ser. No. 16/186,233 filed on Nov. 9, 2018, which is now U.S. Pat. No. 10,597,192, the disclosures of which are incorporated herein by reference

BACKGROUND

This disclosure relates generally to a beverage can lid having an opening, and more particularly to a resealable beverage can lid for covering the opening.

Beverage cans for containing liquids such as a carbonated beverages have become a universal and ubiquitous product. The beverage can is typically constructed of an aluminum alloy composition that may include aluminum, magnesium, manganese, silicon, and copper. The beverage can consists of a can body into which a liquid is filled and a can lid or end that is sealed to the can body. The can body may include a base or bottom that is dome shaped to resist internal pressure, a generally cylindrical section, a narrowed neck portion, and an open top edge. The can lid may include the lid portion that is about the same circumference as the narrowed neck portion of the can body, a scored opening or weakened portion, a tab portion that is used to open the scored opening, and a rivet that is used to secure the tab to the lid portion. The rivet is an integral piece of the lid portion and is formed by stretching the center of the lid portion upwardly and then drawn to form the rivet. The lid is sealed to the can body by trimming the open top edge of the can body, bending the trimmed edge, and seaming the bent trimmed edge to the lid. In this manner, any liquid contained within the can body is sealed. To open the beverage can the tab is lifted to press against the scored opening to partially push the scored opening into the can body to create an opening in the lid. The portion of the scored opening that is pushed into the can body is a panel. The panel does not fully detach from the lid due to a hinge portion formed in the lid. Once opened, liquid from inside the can body may flow through the opening.

One problem associated with the use of the beverage can is that once opened it cannot be closed again. Since the liquid within the beverage can may be carbonated, after a period of time the carbonation escapes and the liquid becomes flat or stale. Once flat, the beverage can and its contents may be discarded which may be wasteful. Also, after opening the beverage can the contents may have to be consumed quickly because the contents cannot be preserved. Further, it is also possible that the contents of the beverage can may spill due to not being able to close the opening. In particular, when an individual is walking with an opened can the individual may trip or fall and the contents of the can may be spilled because the can is open. This may also be problematic if the beverage can is stationary and near electrical equipment such as a computer or a laptop and the can is accidentally knocked over. It is also possible that insects, contaminants, or other unwanted matter may infiltrate the beverage can through the opening. If this occurs then the beverage can and its contents should be thrown away.

The present disclosure is designed to obviate and overcome many of the disadvantages and shortcomings experienced with prior beverage can constructions. Particularly, it would be advantageous to be able to have a resealable beverage can lid for preserving the contents of the beverage can. Moreover, the present disclosure is related to a resealable beverage can lid that can be easily resealed for later use, to prevent spillage, or to prevent contaminants from entering into the can once opened.

SUMMARY

In one form of the present disclosure, a resealable beverage can lid is disclosed which comprises a lid having a top side having a partial score line forming a panel and a hinge, a rivet formed in the lid and extending outwardly from the top side of the lid, a tab portion connected to the rivet, and a latch element formed in the panel.

In another form of the present disclosure, a resealable beverage can lid comprises a lid having a top side having a partial score line forming a panel and a hinge, a rivet formed in the lid and extending outwardly from the top side of the lid, a tab portion connected to the rivet, the tab portion having a capturing portion, and a latch element formed in the panel for being captured by the capturing portion of the tab portion.

In still another form of the present disclosure, a resealable beverage can lid comprises a lid having a top side having a partial score line forming a panel and a hinge with the panel capable of being partially freed from the lid along the partial score line with the hinge preventing the panel from being completely freed from the lid with the panel being moved from a closed position to an opened position once the panel is partially freed from the lid, a rivet formed in the lid and extending outwardly from the top side of the lid, a tab portion connected to the rivet, the tab portion having a front capturing portion and a rear lifting portion, and a latch element formed in the panel with the latch element capable of being captured by the front capturing portion for movement of the panel back into the closed position.

In light of the foregoing comments, it will be recognized that the resealable beverage can lid of the present disclosure is of simple construction and design and which can be easily employed with highly reliable results.

The present disclosure provides a resealable beverage can lid that may be used to reseal an opened beverage can in order to preserve the contents of the beverage can for later use.

The present disclosure provides a resealable beverage can lid that employs an easy to use closure mechanism that allows an individual to reseal the lid of an opened beverage can.

The present disclosure provides a resealable beverage can lid that does not require any special tools to use the resealable beverage can lid.

The present disclosure also provides a resealable beverage can lid that can be used with any sized beverage can.

The present disclosure provides a resealable beverage can lid that can be constructed using readily available materials and construction techniques and machinery.

The present disclosure also provides a resealable beverage can lid having a closure mechanism that does not add significantly to the cost of manufacturing the beverage can lid.

The present disclosure is also directed to a resealable beverage can lid that can be used to open and close the lid of an opened beverage can several times.

The present disclosure is further directed to a resealable beverage can lid that is capable of easily re-closing a beverage can once the beverage can is opened.

These and other advantages of the present disclosure will become apparent after considering the following detailed specification in conjunction with the accompanying drawings, wherein:

DETAILED DESCRIPTION OF A PREFERRED EMBODIMENT

Figure 1:
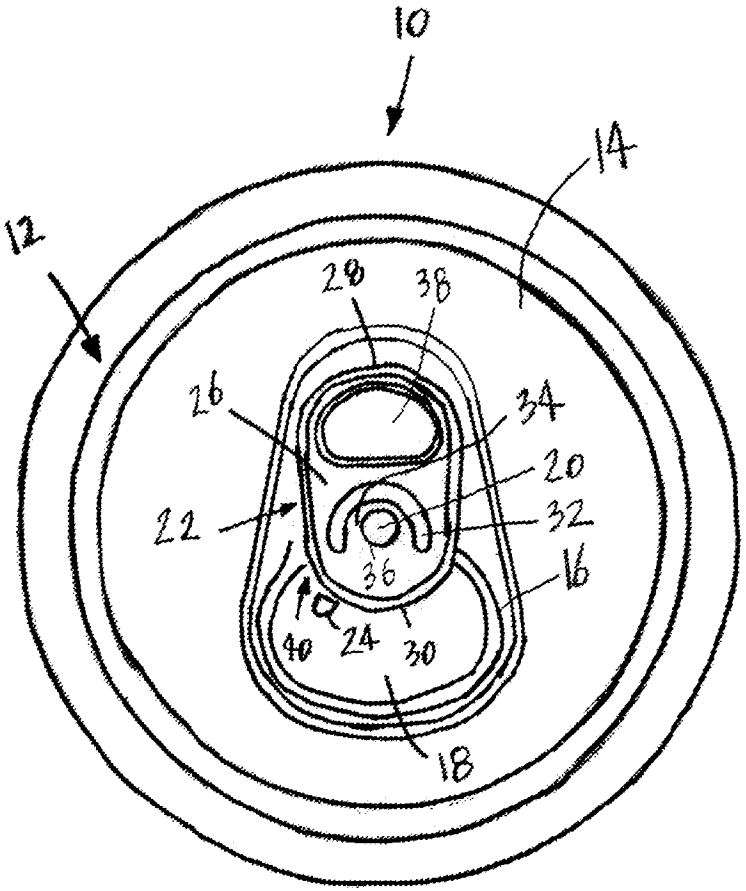
FIG. 1 is a top view of a resealable beverage can lid constructed according to the present disclosure.

Referring now to the drawings, wherein like numbers refer to like items, number 10 identifies a preferred embodiment of a resealable beverage can lid constructed according to the present disclosure. Referring now to FIG. 1, the resealable beverage can lid 10 is shown to comprise a lid 12 having a top side 14 having a score line 16 partially surrounding a panel 18. The lid 12 has a rivet 20 formed therein with the rivet 20 extending outwardly from the top side 14 of the lid 12. A tab element or portion 22 is connected to the rivet 20. The tab portion 22 is used to open the lid 12 by rupturing the score line 16, as will be explained in more detail herein. The panel 18 has a socket, catch, or latch element 24 formed therein. The tab portion 22 comprises a main body portion 26 having a rear lifting portion 28 and a forward rupturing or capturing portion 30. A generally U-shaped opening 32 is used to form a generally semicircular portion or tongue 34 that has an aperture 36 formed therein for receiving the rivet 20. In this manner, the tab portion 22 is staked or held to the lid 12. The aperture 36 also allows the tab portion 22 to rotate or move about the rivet 20. An opening 38 may also be formed in the rear lifting portion 28 of the tab portion 22. Since the score line 16 only partially surrounds the panel 18, the panel 18 is not totally freed from the lid 12 when the score line 16 is ruptured. A hinge portion 40 is formed in the lid 12 between where the score line 16 begins and ends. In essence, the hinge portion 40 prevents the panel 18 from becoming fully separated or detached from the lid 12. As can be appreciated, the lid 12 is shown in a closed or unopened condition in that score line 16 has not been ruptured to partially separate the panel 18 from the lid 12.

Figure 2:
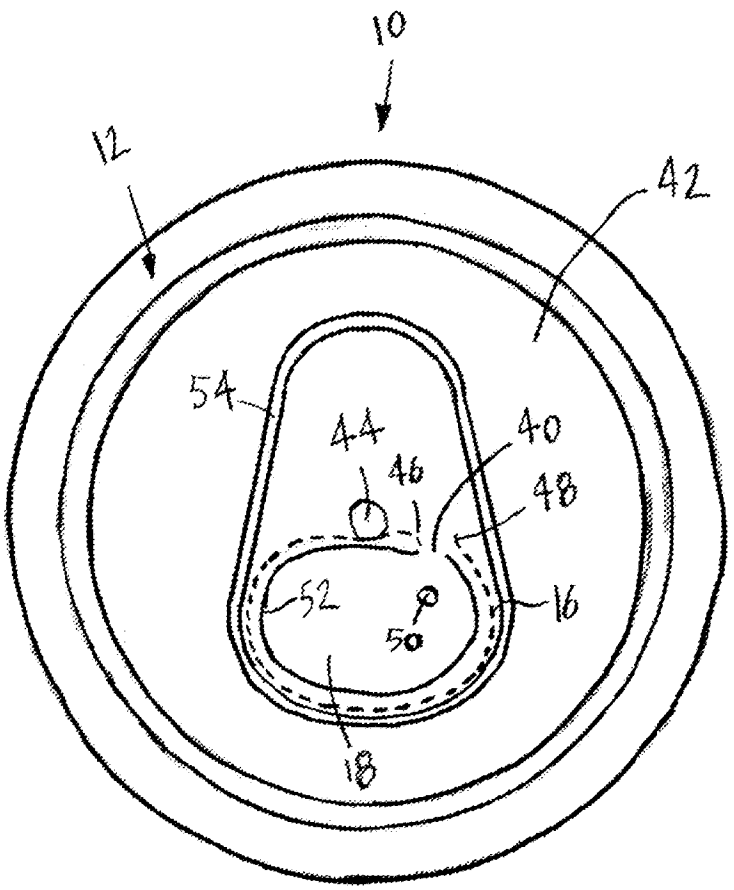
FIG. 2 is a bottom view of the resealable beverage can lid shown in FIG. 1.

FIG. 2 is a bottom view of the lid of the resealable beverage can lid 10. The lid 12 has a bottom side 42 having a rivet indentation 44 in the bottom side 42 left over from the manufacturing process that forms the rivet 20 (FIG. 1). The score line 16 is shown in phantom in this particular view. The score line 16 has an initial end 46 and a terminal end 48. Since the score line 16 only partially surrounds the panel 18, there is the hinge portion 40 that is provided that prevents the panel 18 from completely separating from the lid 12. The panel 18 also has a latch element indentation 50 formed in the panel 18 during the manufacturing process that forms the latch element 24 (FIG. 1). The panel 18 may also have an anti-fracture score indentation 52. The bottom side 42 may also have formed therein a reinforcing rib 54 to help in strengthening the lid 12. Again, the lid 12 is shown in a closed or unopened position in that score line 16 has not been fractured or ruptured to partially separate the panel 18 from the lid 12.

Figure 3:
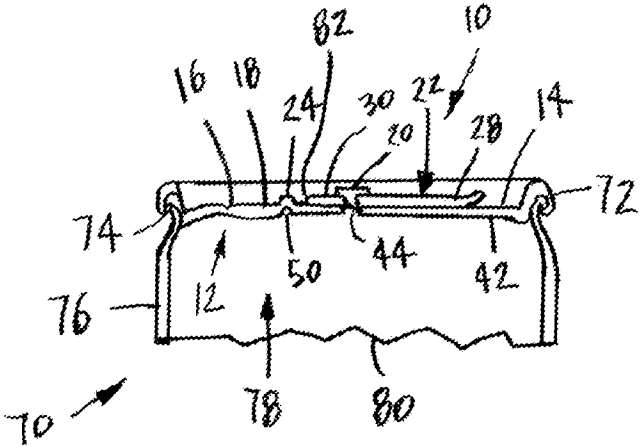
FIG. 3 is a partial cross-sectional view of a beverage can having the resealable beverage can lid constructed according to the present disclosure connected to the beverage can with the resealable beverage can lid being shown in a closed position.

With reference now to FIG. 3, a partial cross-sectional view of the resealable beverage can lid 10 being connected to a beverage can 70 is shown. The lid 12 has a flange 72 that is shaped to receive a neck portion 74 of a cylindrical can body 76. The can body 76 has an interior 78 in which a liquid 80, such as a carbonated beverage, is filed. As can be appreciated, the lid 12 is used to seal or cap the neck portion 74 of the can body 76. The lid 12 has the top side 14 having the score line 16 surrounding the panel 18. The panel 18 also has formed therein the latch element 24 that extends outwardly from the top side 14 of the lid 12. The lid 12 also has the bottom side 42 which has the rivet indentation 44 and the indentation 50 formed therein. The rivet 20 is shown on the top side 14 having the tab portion 22 staked to the rivet 20. The rear lifting portion 28 and the forward rupturing or capturing portion 30 of the tab portion 22 are also illustrated. The forward capturing portion 30 has a front edge 82 that is used to hook onto, grab, or capture the latch element 24, as will be explained in detail further herein. The panel 18 is shown in an initial closed position in which the score line 16 has not been ruptured. In essence, the liquid 80 within the beverage can 70 cannot escape because there is no opening in the lid 12.

Figure 4:
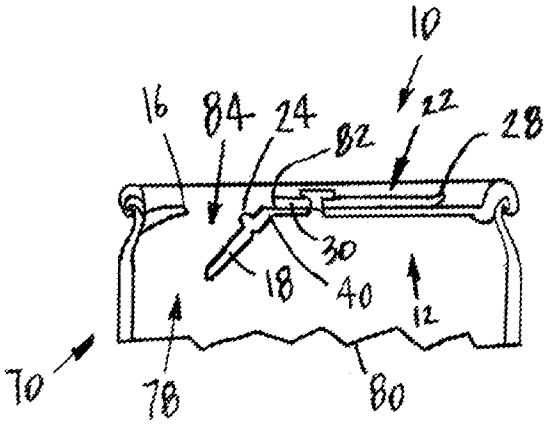
FIG. 4 is a partial cross-sectional view of a beverage can having the resealable beverage can lid constructed according to the present disclosure connected to the beverage can with the resealable beverage can lid being shown in an opened position.

FIG. 4 depicts the resealable beverage can lid 10 being in an opened position with the panel 18 being freed from the lid 12 by the rupturing of the score line 16 and the panel 18 being pushed into or positioned in the interior 78 of the beverage can 70. In order to accomplish the rupturing of the score line 16, the rear lifting portion 28 of the tab portion 22 is lifted up so that the front edge 82 or the front rupturing portion 30 pushes into the panel 18 to rupture or fracture the score line 16. The hinge 40 prevents the panel 18 from falling into the interior 78 or from becoming completely free from the lid 12. In the opened position the liquid 80 within the can 70 is allowed to be emptied through an opening 84 created or left over from the freeing or opening of the panel 18. The latch element 24 is also in a position to be captured or latched onto by the front edge 82 or the capturing portion 30 of the tab portion 22.

Figure 5:
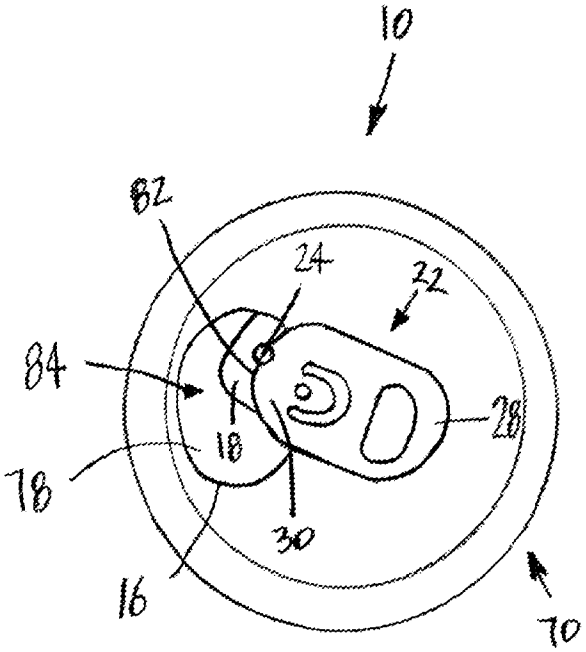
FIG. 5 is a top view of the resealable beverage can lid constructed according to the present disclosure with the panel in the process of being moved to in a closed position.

With reference now to FIG. 5, a top view of the resealable beverage can lid 10 connected to the beverage can 70 is illustrated with the panel 18 in the process of being moved into a closed position. The tab portion 22 has been slightly rotated or moved so that the front edge 82 or the capturing portion 30 of the tab portion 22 captures the latch element 24. In this manner, the tab portion 22 may be used to pull up the panel 18 from the interior 78 of the beverage can 70 to seal or close the opening 84. Once the panel 18 is moved into the closed position any contents within the beverage can 70 are prevented from escaping or being spilled. To reopen the opening 84, the tab portion 22 is lifted by grasping the rear lifting portion 28 to press the panel 18 back into the interior 78 of the beverage can 70. Once the panel 18 is re-positioned into the opened position, any contents within the beverage can 70 may be removed, used, or emptied. Although the latch element 24 is shown being positioned on the panel 18 near the hinge 40 (hidden in this particular view), it is possible and contemplated that the latch element 24 may be positioned on the panel 18 where the capturing portion 30 or the front edge 82 of the tab portion 22 is capable capturing or hooking onto or grabbing the latch element 24.

Figure 6:
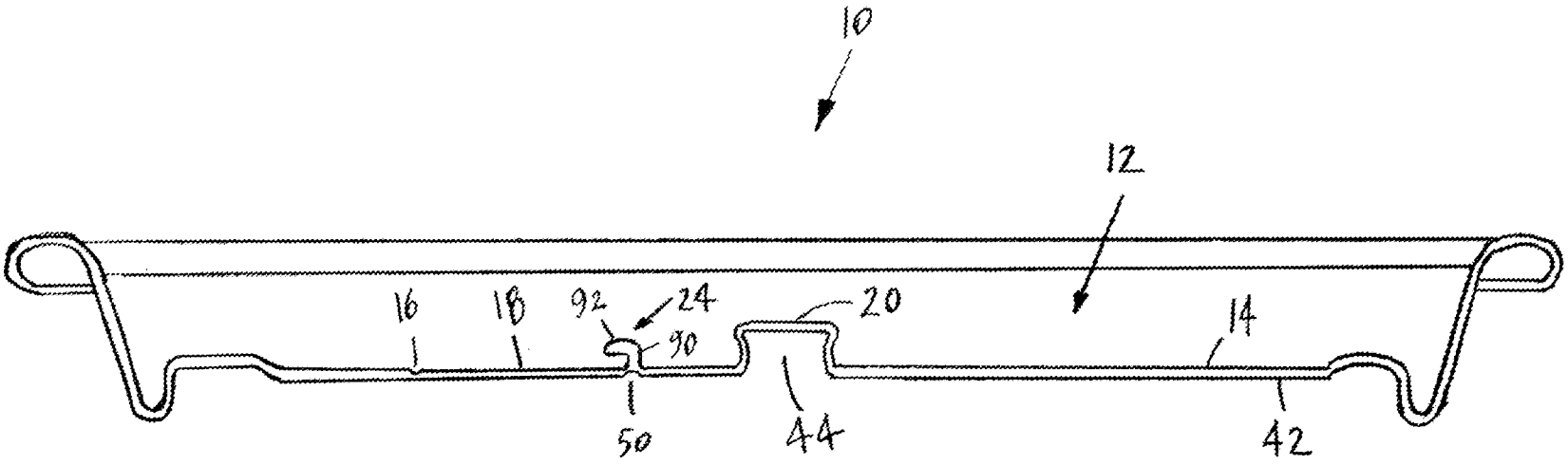
FIG. 6 is an enlarged cross-sectional view of the resealable beverage can lid constructed according to the present disclosure with the tab portion removed for clarity.

FIG. 6 shows an enlarged cross-sectional view of the resealable beverage can lid 10 with the tab portion 22 removed for clarity. The resealable beverage can lid 10 has the lid 12 having the top side 14 and the bottom side 42. The top side 14 has the score line 16 formed therein for outlining and forming the panel 18. The lid 12 has the rivet 20 formed therein with the rivet 20 extending outwardly from the top side 14 of the lid 12. The rivet 20 has the rivet indentation 44 formed in the bottom side 42 of the lid 12 during the manufacturing process that forms the rivet 20. The latch element 24 also has the indentation 50 formed in the bottom side 42 of the lid 12. The latch element 24 extends outwardly from the top side 14 of the lid 12. The latch element 24 comprises a main body 90 having a leg portion 92 that extends outwardly from the main body 90. The leg portion 92 functions as a hook for the capturing portion 30 (FIG. 1) or the front edge 82 (FIG. 3) to grab, latch to, or capture to be able to move the panel 18 into the closed position.

Figure 7:
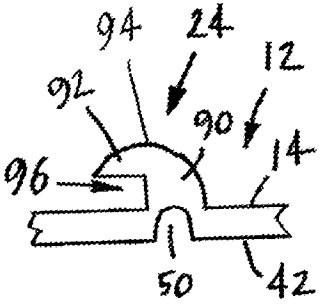
FIG. 7 is an enlarged partial cross-sectional view of a latch element of the resealable beverage can lid.

Referring now in particular to FIG. 7, an enlarged partial cross-sectional view of the latch element 24 is shown. The latch element 24 comprises the main body 90 that extends outwardly from the top side 14 of the lid 12 on the panel 18 with the leg portion 92 extending outwardly from the main body 90. The main body 90 has a hemispherical head 94. The leg portion 92 and the top side 14 form a hook area 96 for receiving or capturing the capturing portion 30 (FIG. 1) or the front edge 82 (FIG. 3) of the tab portion 20 (FIG. 1). The latch element 24 also has the indentation 50 formed in the bottom side 42 of the lid 12.

Figure 8:
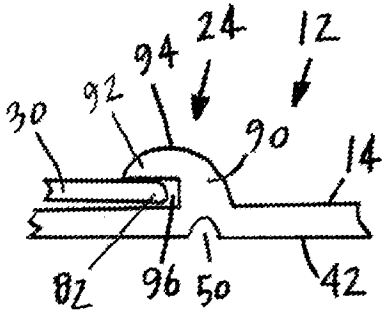
FIG. 8 is an enlarged partial cross-sectional view of the latch element shown in FIG. 7 receiving a tab portion of the resealable beverage can lid.

FIG. 8 depicts the latch element 24 being captured by the capturing portion 30. The capturing portion 30 has the front edge 82 inserted into the hook area 96. The latch element 24 is also shown comprising the main body 90 that extends outwardly from the top side 14 of the lid 12 with the leg portion 92 extending outwardly from the main body 90. The main body 90 has the hemispherical head 94. The latch element 24 also has the indentation 50 formed in the bottom side 42 of the lid 12.

Figure 9:
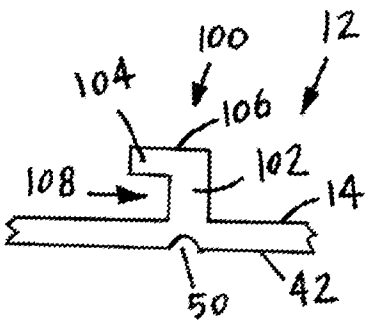
FIG. 9 is an enlarged partial cross-sectional view of another embodiment of a latch element of the resealable beverage can lid.

With reference now to FIG. 9, another embodiment of a latch element 100 is illustrated. The latch element 100 comprises a main body 102 that extends outwardly from the top side 14 of the lid 12 with a leg portion 104 extending outwardly from the main body 102. The main body 102 has a straight head 106. The leg portion 104 and the top side 14 form a hook area 108 for receiving or capturing the capturing portion 30 (FIG. 1) or the front edge 82 (FIG. 3) of the tab portion 20 (FIG. 1). The latch element 100 also has the indentation 50 formed in the bottom side 42 of the lid 12.

Figure 10:
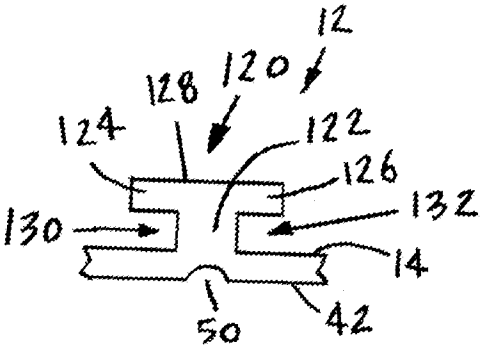
FIG. 10 is an enlarged partial cross-sectional view of another embodiment of a latch element of the resealable beverage can lid.

FIG. 10 shows another embodiment of a latch element 120. The latch element 120 comprises a main body 122 that extends outwardly from the top side 14 of the lid 12. The main body 122 has a first leg portion 124 extending outwardly from the main body 122 and a second leg portion 126 extending outwardly from the main body 122. The main body 122 has a straight head 128. The first leg portion 124 and the top side 14 form a first hook area 130. The second leg portion 126 and the top side form a second hook area 132. The latch element 120 also has the indentation 50 formed in the bottom side 42 of the lid 12.

Figure 11:
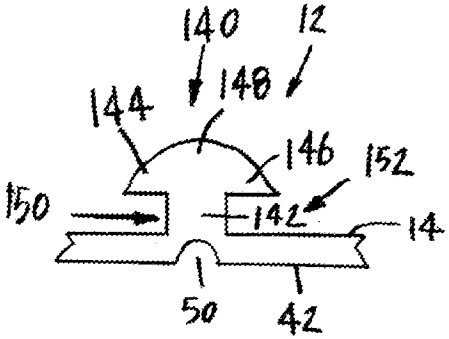
FIG. 11 is an enlarged partial cross-sectional view of another embodiment of a latch element of the resealable beverage can lid.

Referring to FIG. 11, another embodiment of a latch element 140 is illustrated. The latch element 140 comprises a main body 142 that extends outwardly from the top side 14 of the lid 12 with a first leg portion 144 extending outwardly from the main body 142 and a second leg portion 146 extending outwardly from the main body 142. The main body 142 has a semicircular head 148. The first leg portion 144 and the top side 14 form a first hook area 150 for receiving or capturing the capturing portion 30 (FIG. 1) or the front edge 82 (FIG. 3) of the tab portion 20 (FIG. 1). The second leg portion 146 and the top side 14 form a second hook area 152. The latch element 140 also has the indentation 50 formed in the bottom side 42 of the lid 12.

The operation of the resealable beverage can lid 10 may be as follows. The can body 70 is filled with the liquid 80 and the lid 12 is sealed to the can body 70 and the product is then made available for purchase by an individual or consumer. Once purchased and the individual wants to use the product the individual will lift the rear lifting portion 28 of the tab portion 22 which causes the forward rupturing portion 30 to press against the panel 18 to rupture the panel 18 along the score line 16. This causes the panel 18 to move into the interior 78 of the can body 70 to create the opening 84. Once the can body 70 has been opened the rear lifting portion 28 of the tab portion 22 is pressed downwardly which causes the tab portion 22 to return to an initial position. The opening 84 allows the individual to drink the liquid 80 from the can body 70. When the individual wants to close the opening 84 the individual may grasp the rear lifting portion 28 of the tab portion 22 and by moving the rear lifting portion 28 upwardly the capturing portion 30 is moved downwardly into place to capture the latch element 24 on the panel 18. Once captured, the rear lifting portion 28 is pressed or moved back into its initial position which causes the panel 18 to move into a position where the opening 84 is closed or covered by the panel 18. The can body 70 may be held, stored, or refrigerated without concern that the liquid 80 will spill out of the can body 70 or that the liquid 80 will become stale or that the liquid 80 will be contaminated. When the individual desires to again drink from the can body 70 the individual grasps and lifts the rear lifting portion 28 to again use the rupturing portion 30 to press against the panel 18 to again move the panel 18 into the interior 78 to once again uncover the opening 84. As should be appreciated, less force is needed to reopen the opening 84 the second time. As is known, once the liquid 80 from the can body 70 has been consumed, the can body 70 may be recycled.

Preferably, the resealable beverage can lid 10 will be constructed of a relatively lightweight material so that it can be easily used and manufactured. By way of example only, the resealable beverage can lid 10 may be constructed of aluminum or an aluminum alloy.

Although it has been indicated herein that the resealable beverage can lid 10 is used with cans that contain a liquid, such as a carbonated beverage, it is also possible and contemplated that the cans may contain other items such as powders, spices, foods, syrups, gums, candies, or any other item that can be removed from an opening in the lid 10 and may need to be resealed.

From all that has been said, it will be clear that there has thus been shown and described herein a resealable beverage can lid which fulfills the various objects and advantages sought therefor. It will be apparent to those skilled in the art, however, that many changes, modifications, variations, and other uses and applications of the subject resealable beverage can lid are possible and contemplated. All changes, modifications, variations, and other uses and applications which do not depart from the spirit and scope of the disclosure are deemed to be covered by the disclosure, which is limited only by the claims which follow.

What is claimed is:

1. A resealable beverage can lid comprising:

a lid having a top side having a partial score line forming a panel and a hinge;

a rivet formed in the lid and extending outwardly from the top side of the lid;

a tab portion connected to the rivet; and a latch element formed in the panel.

2. The resealable beverage can lid of claim 1 wherein the latch element comprises a main body having an extension portion.

3. The resealable beverage can lid of claim 1 wherein the latch element comprises a main body having a circular head portion.

4. The resealable beverage can lid of claim 1 wherein the panel is capable of being freed from the top side of the lid from a closed position into an opened position and the latch element is capable of being captured by the tab portion for movement of the panel back into the closed position.

5. The resealable beverage can lid of claim 1 wherein the panel is ruptured by the tab portion to form an opening in the lid, and the latch element is capable of being captured by the tab portion for moving the panel into a closed position covering the opening in the lid.

6. The resealable beverage can lid of claim 1 wherein the latch element comprises a main body having a semicircular head portion with the head portion capable of being captured by the tab portion.

7. The resealable beverage can lid of claim 1 wherein the latch element comprises a main body having a leg portion extending out from the main body.

8. A resealable beverage can lid comprising:

a lid having a top side having a partial score line forming a panel and a hinge;

a rivet formed in the lid and extending outwardly from the top side of the lid;

a tab portion connected to the rivet, the tab portion having a capturing portion; and a latch element formed in the panel for being captured by the capturing portion of the tab portion.

9. The resealable beverage can lid of claim 8 wherein the latch element comprises a main body having an extension portion.

10. The resealable beverage can lid of claim 8 wherein the panel is capable of being freed from the top side of the lid from a closed position into an opened position and once the latch element is captured by the capturing portion the panel may be moved back into the closed position.

11. The resealable beverage can lid of claim 8 wherein the panel is ruptured by the capturing portion of the tab portion to form an opening in the lid, and the latch element is capable of being captured by the capturing portion for moving the panel into a closed position covering the opening in the lid.

12. The resealable beverage can lid of claim 8 wherein the latch element comprises a main body having a semicircular head portion with the head portion capable of being captured by the capturing portion.

13. The resealable beverage can lid of claim 8 wherein the latch element comprises a main body having a circular head portion with the circular head portion capable of being captured by the capturing portion.

14. The resealable beverage can lid of claim 8 wherein the latch element comprises a main body having a leg portion extending out from the main body.

15. A resealable beverage can lid comprising:

a lid having a top side having a partial score line forming a panel and a hinge with the panel capable of being partially freed from the lid along the partial score line with the hinge preventing the panel from being completely freed from the lid with the panel being moved from a closed position to an opened position once the panel is partially freed from the lid;

a rivet formed in the lid and extending outwardly from the top side of the lid;

a tab portion connected to the rivet, the tab portion having a front capturing portion and a rear lifting portion; and a latch element formed in the panel with the latch element capable of being captured by the front capturing portion for movement of the panel back into the closed position.

16. The resealable beverage can lid of claim 15 wherein the latch element comprises a main body having an extension portion with the extension portion being captured by the front capturing portion.

17. The resealable beverage can lid of claim 15 wherein the latch element comprises a main body having a semicircular head portion with the head portion capable of being captured by the front capturing portion.

18. The resealable beverage can lid of claim 15 wherein the latch element comprises a main body having a circular head portion with the head portion capable of being captured by the front capturing portion.

19. The resealable beverage can lid of claim 15 wherein the latch element comprises a main body having a leg portion extending out from the main body.

* * * * *